US006289553B1

(12) United States Patent
Dyson

(10) Patent No.: US 6,289,553 B1
(45) Date of Patent: Sep. 18, 2001

(54) VACUUM CLEANER

(75) Inventor: James Dyson, Wiltshire (GB)

(73) Assignee: Notetry Limited (GB)

( * ) Notice: Subject to any disclaimer, the term of this patent is extended or adjusted under 35 U.S.C. 154(b) by 0 days.

(21) Appl. No.: 09/581,765

(22) PCT Filed: Dec. 17, 1998

(86) PCT No.: PCT/GB98/03816

§ 371 Date: Aug. 21, 2000

§ 102(e) Date: Aug. 21, 2000

(87) PCT Pub. No.: WO99/30602

PCT Pub. Date: Jun. 24, 1999

(30) Foreign Application Priority Data

Dec. 17, 1997 (GB) ..... 9726676

(51) Int. Cl.[7] ..... A47L 9/12
(52) U.S. Cl. ..... 15/347; 15/412; 55/485
(58) Field of Search ..... 15/347, 412; 55/485

(56) References Cited

U.S. PATENT DOCUMENTS

| | | | | |
|---|---|---|---|---|
| 2,388,280 | * | 11/1945 | Nuffer et al. | 15/347 X |
| 2,779,432 | * | 1/1957 | Meyerhoefer | 55/485 X |
| 3,046,718 | * | 7/1962 | Ide et al. | 15/347 X |
| 3,621,640 | * | 11/1971 | Ohno | 55/485 X |
| 4,072,483 | | 2/1978 | Doyle, Jr. . | |
| 4,517,705 | * | 5/1985 | Hug | 15/412 X |
| 4,581,050 | | 4/1986 | Krantz . | |
| 4,825,502 | | 5/1989 | Armstrong et al. . | |
| 4,854,006 | | 8/1989 | Nishimura et al. . | |
| 5,230,722 | | 7/1993 | Yonkers . | |
| 5,659,919 | | 8/1997 | Kajihara . | |
| 6,035,486 | * | 3/2000 | McCormick | 15/347 X |

FOREIGN PATENT DOCUMENTS

| | | |
|---|---|---|
| 86 07 553.5 | 3/1986 | (DK) . |
| G 93 17 809.3 | 11/1993 | (DK) . |
| 0 245 224 A1 | 9/1987 | (EP) . |
| 1 549 535 A | 8/1979 | (GB) . |
| 2 137 896 A | 10/1984 | (GB) . |
| 2 167 680 A | 6/1986 | (GB) . |
| 2 295 311 A | 5/1996 | (GB) . |

* cited by examiner

*Primary Examiner*—Chris K. Moore
(74) *Attorney, Agent, or Firm*—Morrison & Foerster LLP

(57) ABSTRACT

The invention provides a vacuum cleaner comprising an airflow path having a dirty air inlet (14) and a clean air outlet (44*e*), a fan (48) for drawing an airflow along the airflow path from the dirty air inlet (14) to the clean air outlet (44*e*), a motor (50) for driving the fan (48), separating apparatus (18) for separating dirt and dust from the airflow, a pre-motor filter (32) arranged upstream of the motor (50) and a post-motor filter (42) arranged downstream of the motor (50), wherein both the pre-motor filter (32) and the post-motor filter (42) are cylindrical filters. The invention further provides a vacuum cleaner comprising an airflow path having a dirty air inlet (14) and a clean air outlet (44*e*), a fan (48) for drawing an airflow along the airflow path from the dirty air inlet (14) to the clean air outlet (44*e*), a motor (48) for driving the fan (50), separating apparatus (18) for separating dirt and dust from the airflow, a pre-motor filter (32) arranged upstream of the motor (50) and a post-motor filter (42) arranged downstream of the motor (50), wherein the post-motor filter (42) is housed in a casing (44) containing a plurality of slots or apertures (44*e*), the slots or apertures (44*e*) forming the clean air outlet and being arranged such that, in use, the airflow is diffused as it leaves the clean air outlet.

21 Claims, 4 Drawing Sheets

VACUUM CLEANER

FIELD OF THE INVENTION

The invention relates to a vacuum cleaner.

BACKGROUND OF THE INVENTION

In general, a vacuum cleaner incorporates a dirty air inlet, separating apparatus for separating dirt and dust from an airflow, a fan and motor for drawing an airflow into the separating apparatus via the dirty air inlet, and an outlet for expelling clean air into the atmosphere. Very often, a pre-motor filter is arranged in the airflow path upstream of the motor to prevent any dust or debris remaining entrained within the airflow from entering the motor. This reduces the risk of the motor becoming damaged or worn as a result of dirt or dust passing therethrough and also prevents such dirt or dust from being expelled into the atmosphere. It is also quite common for a post-motor filter to be arranged downstream of the motor to prevent any carbon particles dislodged within the motor, for example from the brushes within the motor, from being expelled into the atmosphere with the airflow. These pre- and post-motor filters are normally simple filters or pleated filters which are positioned such that they are relatively easily accessibly whilst being unobtrusive during normal use of the vacuum cleaner. Known vacuum cleaners house the pre- and post-motor filters in cassettes slidably receivable in slots or sockets in the motor casing or within the main casing so that they become visible when the cleaner is opened to allow the separating apparatus to be emptied A disadvantage of the existing pre- and post-motor filters is that they are often relatively small in size, which means that the available filtering surface is relatively small. The filters can therefore become clogged over a period of time, despite the small amount of dust and debris they collect, which can affect the performance of the vacuum cleaner. They therefore require to be cleaned or changed more often than is desirable and this leads to increased costs and/or customer dissatisfaction. A further disadvantage is that, because the filters are generally hidden during normal operation of the vacuum cleaner, the user of the vacuum cleaner is often unaware that the pre- or post-motor filter may require changing which frustrates the user of the vacuum cleaner.

Another disadvantage of known vacuum cleaners relates to the cleaner outlet. Very often, the clean air is expelled to the atmosphere in the form of a stream of air. In some cases the expelled air is directed in front of the cleaner which can disturb debris which the user intended to pick up with the cleaner. Streams of expelled air can also cause difficulties such as extinguishing pilot lights on gas fires or disturbing curtains, other furnishing or papers lying near the vacuum cleaner. The more powerful the motor of the cleaner, the more likely the expelled air is to cause a disturbance.

It is an object of the present invention to provide a vacuum cleaner having pre- and post-motor filters which do not require to be cleaned or replaced as frequently as known cleaners. It is a further object to provide a vacuum cleaner having pre- and post-motor filters, in which the fact that one or both of the filters requires cleaning or replacement is more readily apparent to a use of the vacuum cleaner than is currently the case. A still further object of the invention is to provide a vacuum cleaner in which the stream of air exiting the clean air outlet is less likely to cause difficulties than in known vacuum cleaners.

SUMMARY OF THE INVENTION

The invention provides a vacuum cleaner which utilizes cylindrical filters that expose a significantly larger filtration surface area to the airflow which extends the useful life of each filter. The preferable co-axial arrangement of the filters with the airflow passing through the centre of the post-motor filter allows the filters to be conveniently located adjacent one another so that they can be accessed easily, should cleaning or replacement be required.

The invention also provides a vacuum cleaner which diffuses air as it exits the outlet. This diffusion reduces the intensity of the exiting airstream which avoids the problems mentioned above and reduces customer dissatisfaction.

BRIEF DESCRIPTION OF THE DRAWINGS

An embodiment of the invention will now be described with reference to the accompanying drawings, wherein.

DETAILED DESCRIPTION OF THE INVENTION

Figure 1A:
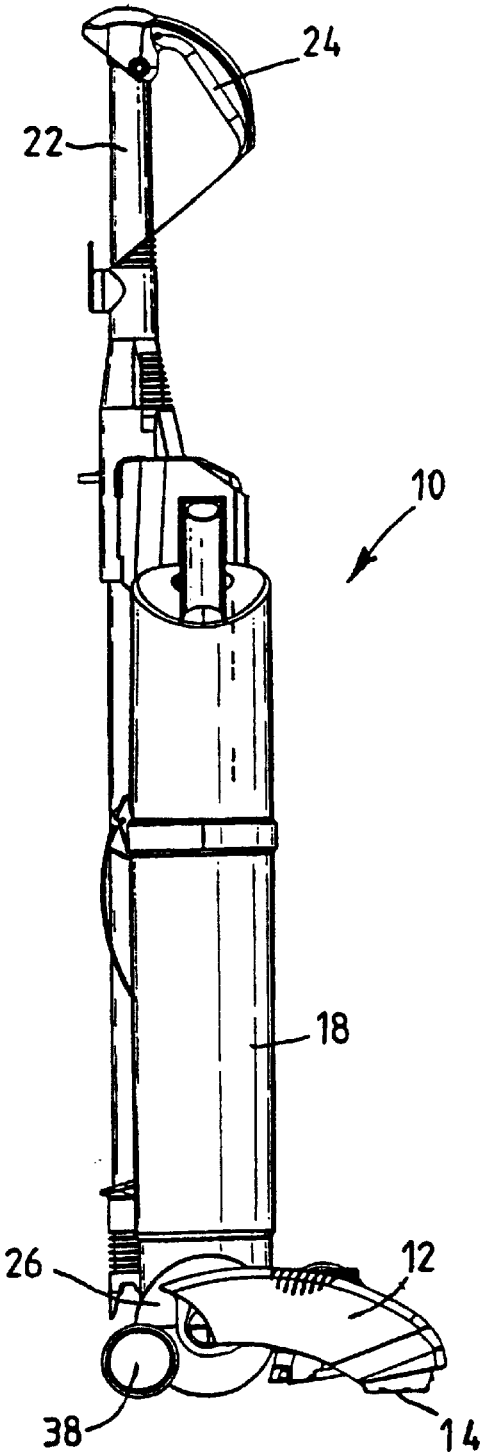
FIGS. 1*a* and 1*b* are side and front views respectively of a vacuum cleaner according to the invention.
Figure 1B:
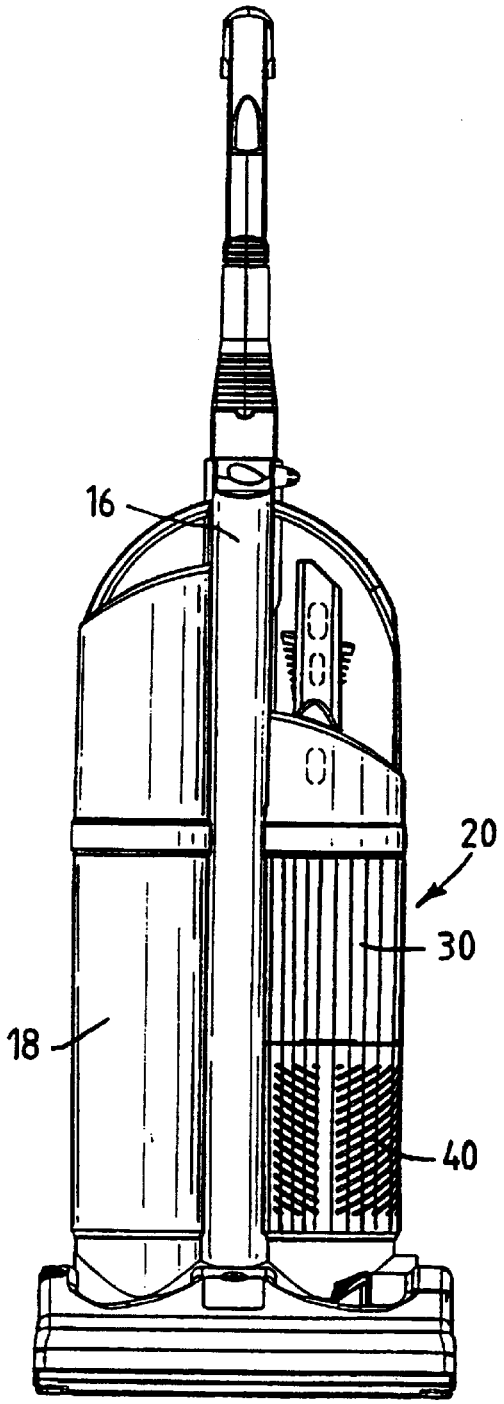

A vacuum cleaner according to the invention is illustrated in FIGS. 1*a* and 1*b*. As can readily be seen, the vacuum cleaner 10 is an upright cleaner having a cleaner head 12 which incorporates a dirty air inlet 14. A central support member 16 supports dust separating apparatus 18 on one side thereof and a filter arrangement 20 on the other side thereof. An upwardly extending handle 22 is positioned rearwardly of the central support member 16 and is optionally releasable in the manner of a wand if the vacuum cleaner 10 is to be used in the cylinder mode. The upwardly extending handle 22 incorporates a hand grip 24 and other features which do not form part of the present invention. The cleaner head 12 is pivotably attached to a motor casing 26 to which support wheels 28 are attached and inside which a motor is located In use, the motor draws dirty air into the vacuum cleaner 10 via the dirty air inlet 14 or alternatively via the wand 22. The air then passes through the dirt and dust separating apparatus 18 and through the filter assembly 20 before being expelled to the atmosphere.

The dirt and dust separating apparatus 18 does not form part of the present invention. The separating apparatus 18 can take the form of a bag or other separating means, e.g. cyclonic separating apparatus. In the example shown, it is envisaged that the dirt and dust separating apparatus 18 will take the form of two concentric cyclones designed to remove dirt and dust particles from the airflow. The airflow is fed to the dirt and dust separating apparatus 18 via conduits housed within the central support member 16.

Once the airflow has passed through the dirt and dust separating apparatus 18, it is then transferred, via a conduit housed within the central support member 16, to the filter assembly 20. The filter assembly 20 is located on the side of the central support member 16 remote from the dirt and dust separating apparatus 18.

It is envisaged that the general shape of the filter assembly 20 will be similar to that of the dirt and dust separating apparatus 18. For example, in the embodiment shown, the dirt and dust separating apparatus 18 will be generally cylindrical in shape and the filter assembly 20 will therefore also be cylindrical in shape with substantially the same diameter as that of the dirt and dust separating apparatus 18.

Figure 2A:
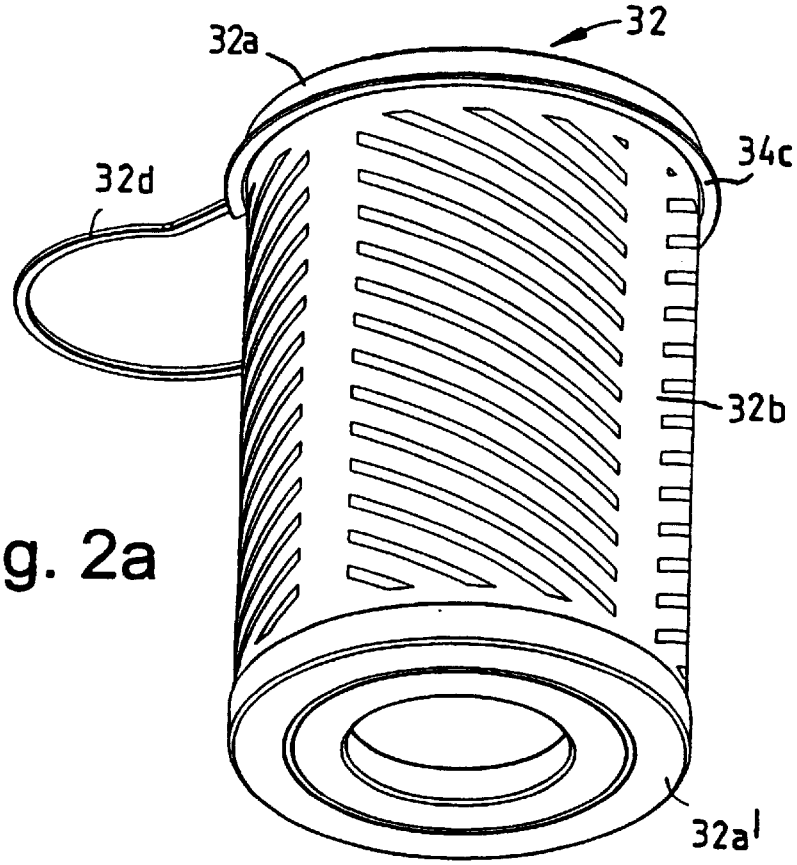
FIGS. 2*a* and 2*b* are isometric views of the pre-motor filter and the pre-motor filter housing respectively, each forming part of the vacuum cleaner of FIGS. 1*a* and 1*b*.
Figure 2B:
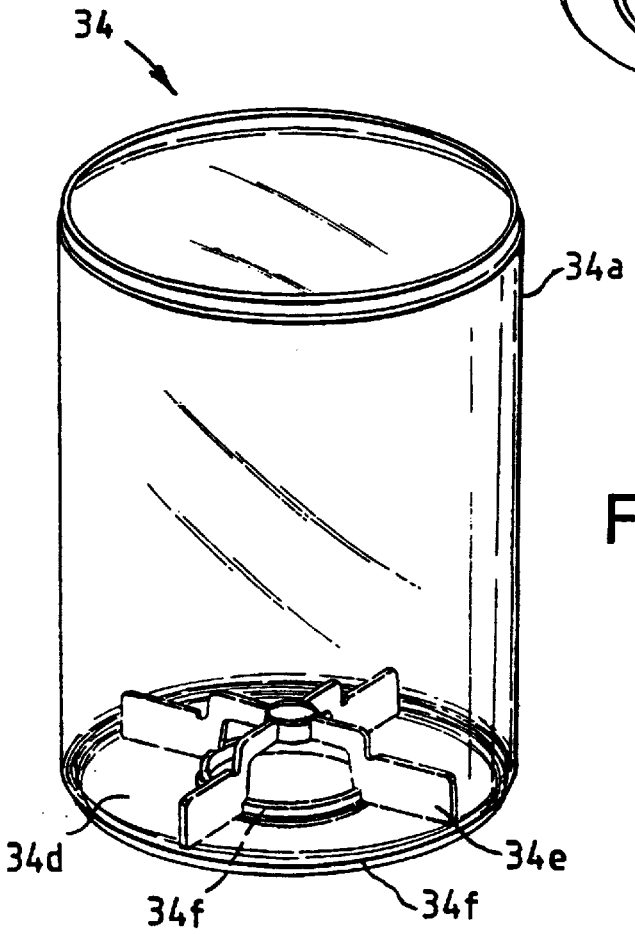
Figure 3A:
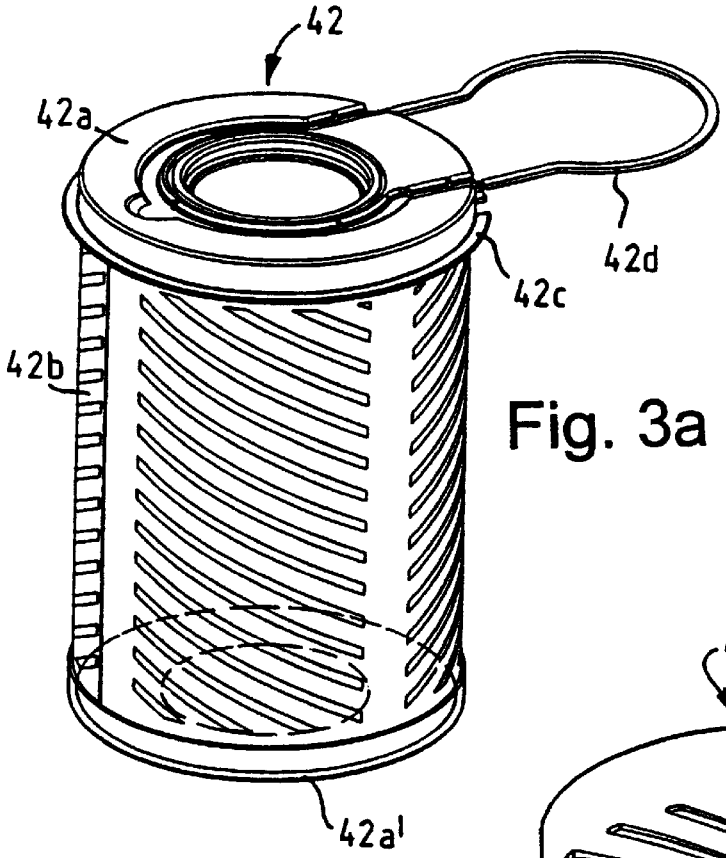
FIGS. 3*a* and 3*b* are isometric views of the post-motor filter and the post-motor filter housing respectively, each forming part of the vacuum cleaner of FIGS. 1*a* and 1*b*.
Figure 3B:
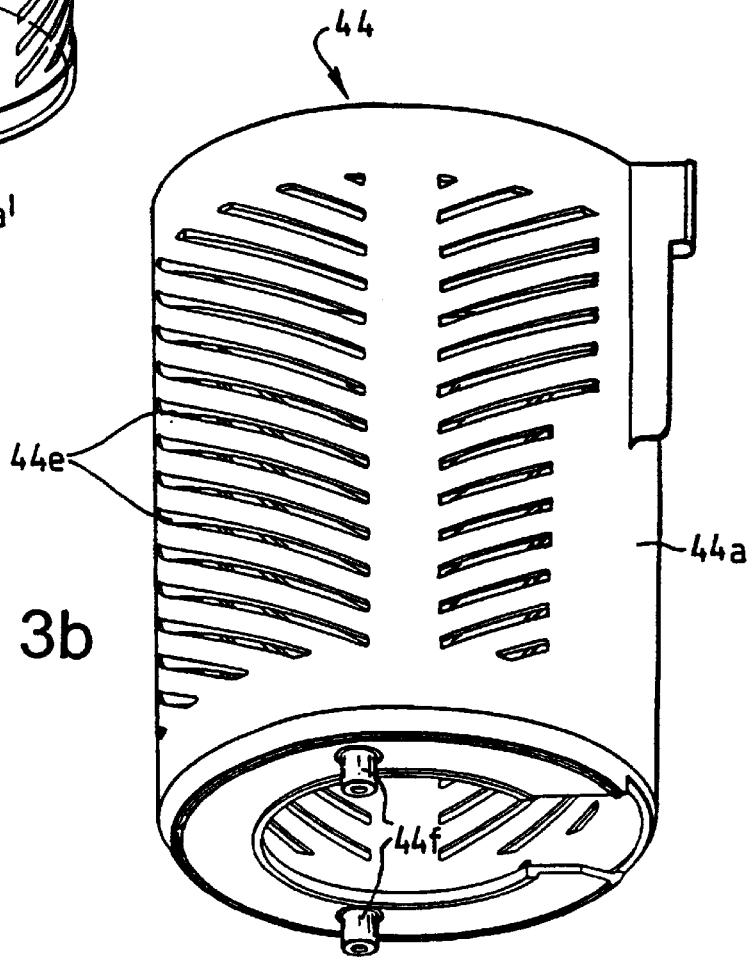

The filter assembly 20 consists of a pre-motor filter assembly 30 and a post-motor filter assembly 40. The pre-motor filter assembly 30 is illustrated in FIGS. 2*a* and 2*b* and the post-motor filter assembly 40 is illustrated in FIGS. 3*a* and 3*b*. Each assembly 30,40 consists of a cylindrical filter 32,42 located within a housing 34,44. In each cylindrical filter 32,42, the filtration material is pleated and formed into a cylindrical shape with caps 32*a*,32*a*',42*a*,42*a*' located at either end to maintain the shape of the filter. The pleating of each filter, the support mesh 32*b*,42*b* and the fitting of the filtration material into the end caps 32*a*,32*a*', 42*a*,42*a* are all standard and known in the art. These details will not be described any further here.

Each housing 34,44 is designed and arranged to hold the respective filter 32,42. Each housing 34,44 is also designed and arranged so as to direct the airflow entering the filter assembly 20 along the correct airflow path. The pre-motor filter housing 34 has a generally cylindrical outer wall 34*a* whose diameter is approximately 10 mm larger than the external diameter of the pre-motor filter 32. This allows an annular chamber 34*b* to be formed between the outer surface of the pre-motor filter 32 and the cylindrical outer wall 34*a* of the housing 34. The upper end of the outer wall 34*a* is open to allow the pre-motor filter 32 to be dropped into the housing 34 with ease. A collar 34*c* extending outwardly from the upper end cap 32*a* centralises the filter 32 when dropped into the housing 34. A loop-shaped tab 32*d* is fixed to the upper end cap 32*a* to allow the filter 32 to be easily removed from the housing 34 when required. A similar collar 42*c* and tab 42*d* are fixed to the upper end cap 42*a* of the post-motor filter 42 for the same reason.

At the lower end of the pre-motor housing 34 is an annular base 34*d* having a cylindrical opening in the centre thereof. Upstanding from the annular base 34*d* are a plurality of upstanding webs 34*e* on which the lower end of the pre-motor filter 32 is supported. Radial channels are formed between the upstanding webs 34*e* along which the airflow can pass. A ridge or groove 34*f* is formed in the annular base 34*d* around the periphery thereof to receive the post-motor filter housing 44.

The lower end of the pre-motor filter 32 is closed by means of the cap 32*a*' extending across the central aperture of the cylindrical filter 32. In this way, air is prevented from passing down the centre of the pre-motor filter 32 beyond the end cap 32*a*'.

The post-motor filter housing 44 also consists generally of an outer cylindrical wall 44*a*. The diameter of the outer cylindrical wall 44*a* is approximately 10 mm greater than the outer diameter of the post-motor filter 42. This allows an annular chamber 44*c* to be created therebetween. A plurality of slots 44*e* are provided in the outer wall 44*a* and extend around substantially all of the circumference thereof. Bosses 44*f* are provided on the base of the post-motor filter housing 44 for receiving screws (not shown).

An inner cylindrical wall 44*b* forming part of the motor casing of the vacuum cleaner extends upwardly through the centre of the cylindrical post-motor filter 42. The upper lip of the inner cylindrical wall 44*b* is dimensioned and arranged so as to abut against the inner circumference of the annular base 34*d* of the pre-motor filter housing 34. Sealing means 45 are provided between the upper lip and the annular base 34*d*. The lower end of the inner cylindrical wall 44*b* is integral with a conduit 46 arranged in the motor casing 26 which leads the airflow through the fan 48 and past the motor 50 before returning it to the post-motor filter 42.

The diameter of the inner cylindrical wall 44*b* is approximately 15 mm less than the inner diameter of the post-motor filter 42 so that a second annular chamber 44*d* is created therebetween. The second annular chamber 44*d* communicates with the conduit 46 downstream of the fan 48 and the motor 50. This portion of the conduit 46 is essentially the exhaust side of the motor housing.

The filter assembly 20 operates in the following manner. The airflow enters the pre-motor filter assembly 30 via a conduit 31 which communicates with the interior of the pre-motor filter 32. There being no axial escape route due to the cap 32*a* at the bottom of the filter 32 extending across the interior of the filter 32, the airflow is forced to pass through the filter 32 in an outwardly radial direction. The airflow then enters the annular chamber 34*b* and passes downwardly to the conduits arranged between the upwardly extending webs 34*e*. The airflow passes radially inwardly between the webs 34*e* and then passes axially down inside the inner cylindrical wall 44*b* within the post-motor filter housing 44. The airflow thus by-passes the post-motor filter 42 until it has passed along the conduit 46 leading to the fan 48 and the motor 50. The airflow passes through the fan 48, around the motor 50, thus having a cooling effect, and then back into the second annular chamber 44*d* located between the post-motor filter 42 and the inner cylindrical wall 44*b*. Because the upper end of the post-motor filter 42 is sealed to the top of the inner cylindrical wall 44*b*, the airflow is forced to pass through the post-motor filter 42. It then passes through the annular chamber 44*c* and exits the post-motor filter housing 44 via the slots 44*e* into the atmosphere.

The conduit 46 and inner cylindrical wall 44*b* form part of the motor casing 26 of the vacuum cleaner 10 or may take the form of separate parts fixed to or located within the motor casing. The fan 48 and the motor 50 are also permanently housed within the motor casing 26. However, the pre-motor filter 32, the post-motor filter 42 and the pre-motor filter housing 34 are all removable from the vacuum cleaner 10. The post-motor filter housing 44 is permanently fixed by means of screws, preferably by passing the screws upwardly through bores in the motor casing and into the bosses 44*f*, into the position shown in FIG. 1*b*. The post-motor filer 42 is made accessible by removing the pre-motor filter housing 34 from the vacuum cleaner 10. The post-motor filter 42 can then be removed from the fixed post-motor filter housing 44 via its open upper end.

Figure 4:
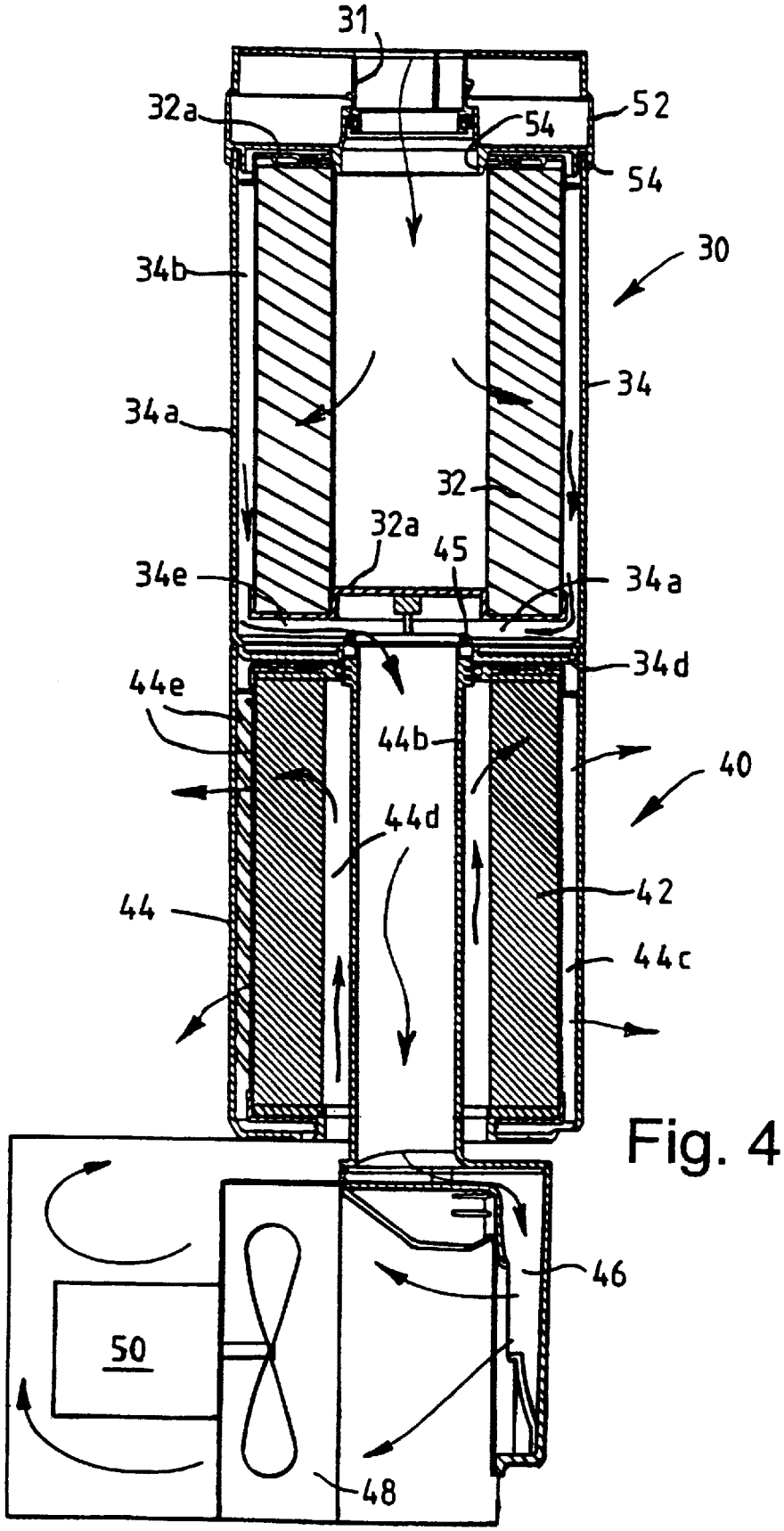
FIG. 4 is a sectional side view of the filters of FIGS. 2 and 3 illustrated in coaxial arrangement as in use.

At the upper end of the filter assembly 20, a releasable fastening device must be employed. Any appropriate releasable fastening means will suffice; for example, a snap-fit arrangement or releasable clip. The arrangement illustrated in FIG. 4 consists of a rotatable collar 52 which, in its operational position, is biased into a downward position. A depending tube 54 having cylindrical walls makes a seal with the inner circumference of the end cap 32*a* of the pre-motor filter 32 so as to ensure that an airflow entering the filter assembly 20 is directed into the interior of the pre-motor filter 32, and also with the upper lip of the outer cylindrical wall 34*a* of the pre-motor filter housing 34. The tube 54 centralises and maintains the pre-motor filter 32 and the pre-motor filter housing 34 in the appropriate position. The ridge or groove 34*f* at the lower end of the cylindrical wall 34*a* maintains the desired relative positions of the pre-motor filter housing 34 and the post-motor filter housing 44.

The collar 52 is designed so as to be rotatable with respect to the body of the vacuum cleaner and also with respect to the pre-motor filter housing 34. Cam surfaces (not shown) are provided such that, when the collar 52 is rotated, it is lifted with respect to the pre-motor filter housing 34 so that the tube 54 depending from the collar 52 is raised clear of the filter 32 and the housing 34. Biasing means (not shown) are provided in order to bias the collar 52 into its downward position in order to avoid inadvertent raising of the collar 52. The biasing means can take the form of a stop detail in the profile of the cam surfaces, resilient plastic strips, deformable foam materials, torsion springs etc.

In order to remove the filter assembly 20 from the vacuum cleaner 10, the collar 52 is rotated against the action of the biasing means. The cylindrical walls of the tube 54 depending from the collar 52 are raised clear of the filter 32 and the cylindrical wall 34*a* of the housing 34. This allows the housing 34 to be lifted slightly and removed from the post-motor filter housing 44. As soon as the pre-motor filter housing 34 has been removed, the post-motor filter 42 can be removed from the post-motor filter housing 44 merely by lifting it from the housing 34. The pre-motor filter 32 can also be lifted or tipped out of its housing 34. Removing either or both housings 34,44 means that either or both filters 32,42 can be removed or replaced as desired.

The housings 34, 44 are moulded from transparent plastics materials. The transparency of the cylindrical walls 34*a*,44*a* of the housings 34,44 allows a user of the vacuum cleaner 10 to inspect the filters 32,42 for signs of clogging. There is no requirement that the pre-motor filter 32 and post-motor filter 42 be inspected only when the dust separating apparatus 18 are accessed for emptying purposes. The filters 32,42 are visible to the user at all times and the user can therefore readily determine whether or not either or both filters 32,42 require replacement. Because both the pre-motor filter 32 and the post-motor filter 42 are cylindrical filters having large filtration surface areas, it is envisaged that neither filter 32,42 will require replacement very often.

The slots 44*e* located in the post-motor filter housing 44 extend around substantially all of the circumference of the housing 44. The substantial area through which the airflow is expelled from the vacuum cleaner 10 means that the strength of the exiting airflow is not high. Furthermore, because the slots are arranged on a curved surface, in this case a cylindrical surface, the airflow is diffused as it leaves the vacuum cleaner. The strength of the airflow is thereby considerably reduced and therefore the problems previously associated with concentrated airflows are avoided.

As a further example, the following dimensions are given in order to further enable a skilled reader to the put the invention into practice.

| | |
|---|---|
| External diameter of filters 32, 42 | 10 cm |
| Internal diameter of filters 32, 42 | 5.2 cm |
| Length of filters 32, 42 | 14 cm |
| Internal diameter of outer cylindrical walls 34a, 44a | 11 cm |
| External diameter of inner cylindrical wall 44b | 3.7 cm |

The scope of the invention is not limited to the precise details of the embodiment described above. Modifications and variations will be apparent to a reader skilled in the art For example, the post-motor filter housing can be made releasable from the motor casing if desired.

What is claimed is:

1. A vacuum cleaner comprising a dirty air inlet and a clean air outlet, a fan for drawing an airflow along an airflow path from the dirty air inlet to the clean air outlet, a motor for driving the fan, separating apparatus for separating dirt and dust from the airflow, a pre-motor filter arranged upstream of the motor and a post-motor filter arranged downstream of the motor, wherein both the pre-motor filter and the post-motor filter are cylindrical filters.

2. A vacuum cleaner as claimed in claim 1, wherein the airflow is arranged to flow radially outwardly through each of the filters when the vacuum cleaner is in use.

3. A vacuum cleaner as claimed in claim 1, wherein the pre-motor filter and the post-motor filter are each housed in a transparent casing.

4. A vacuum cleaner as claimed in claim 3, wherein the pre-motor filter and the post motor filter are housed in separate transparent casings.

5. A vacuum cleaner as claimed in claim 4, wherein the cylindrical filters are arranged coaxially and adjacent one another, the airflow path passing through the centre of the post-motor filter between the pre-motor filter and the motor.

6. A vacuum cleaner as claimed in claim 5, wherein the cylindrical filters are positioned generally upright and parallel to the separating apparatus, the upper end of the uppermost casing being held in place by means of a retractable collar.

7. A vacuum cleaner as claimed in claim 6, wherein the collar is biased into a non-retracted position in which the uppermost casing is retained in place.

8. A vacuum cleaner comprising a dirty air inlet and a clean air outlet, a fan for drawing an airflow along the airflow path from the dirty air inlet to the clean air outlet, a motor for driving the fan, separating apparatus for separating dirt and dust from the airflow, a pre-motor filter arranged upstream of the motor and a post-motor filter arranged downstream of the motor, wherein the post-motor filter is housed in a casing containing a plurality of slots or apertures, the slots or apertures forming the clean air outlet and being arranged such that, in use, the airflow is diffused as it leaves the clean air outlet.

9. A vacuum cleaner as claimed in claim 8, wherein the casing is cylindrical and the slots or apertures extend around at least part of the circumference thereof.

10. A vacuum cleaner as claimed in claim 9, wherein the slots or apertures extend around at least half of the circumference of the casing.

11. A vacuum cleaner as claimed in claim 8, wherein the casing is transparent.

12. A vacuum cleaner as claimed in claim 1, wherein the airflow is arranged to pass across or around the motor to provide cooling.

13. A vacuum cleaner as claimed in claim 1, wherein the separating apparatus comprises at least one cyclone.

14. A vacuum cleaner as claimed in claim 13, wherein the separating apparatus comprises two concentric cyclones.

15. A vacuum cleaner as claimed in claim 1, wherein the pre-motor filter and the post-motor filter are substantially the same size.

16. A vacuum cleaner as claimed in claim 15, wherein the pre-motor filter and the post-motor filter have substantially the same characteristics.

17. A vacuum cleaner as claimed in claim 8, wherein the airflow is arranged to pass across or around the motor to proived cooling.

18. A vacuum cleaner as claim s in claim 8, wherein the separating apparatus comprises at least one cyclone.

19. A vacuum cleaner as claimed in claim 18, wherein the separating apparatus comprises two concentric cyclones.

20. A vacuum cleaner as claimed in claim 8, wherein the pre-motor filter and the post-motor filter are substantially the same size.

21. A vacuum cleaner as claimed in claim 20, wherein the pre-motor filter and the post-motor filter have substantially the same characteristics.

* * * * *

US006289553C1

(12) EX PARTE REEXAMINATION CERTIFICATE (6143rd)

United States Patent
Dyson

(10) Number: US 6,289,553 C1
(45) Certificate Issued: Mar. 4, 2008

(54) VACUUM CLEANER

(75) Inventor: James Dyson, Wiltshire (GB)

(73) Assignee: Dyson Technology Limited, Malmesbury, Wiltshire (GB)

Reexamination Request:
No. 90/008,411, Feb. 6, 2007

Reexamination Certificate for:
Patent No.: 6,289,553
Issued: Sep. 18, 2001
Appl. No.: 09/581,765
Filed: Aug. 21, 2000

(22) PCT Filed: Dec. 17, 1998

(86) PCT No.: PCT/GB98/03816

§ 371 (c)(1),
(2), (4) Date: Aug. 21, 2000

(87) PCT Pub. No.: WO99/30602

PCT Pub. Date: Jun. 24, 1999

(30) Foreign Application Priority Data

Dec. 17, 1997 (GB) ..... 9726676

(51) Int. Cl.
*A47L 9/10* (2006.01)
*A47L 9/12* (2006.01)
*A47L 9/00* (2006.01)

(52) U.S. Cl. ..... 15/347; 15/412; 55/485
(58) Field of Classification Search ..... None
See application file for complete search history.

(56) References Cited

U.S. PATENT DOCUMENTS

RE23,852 E * 7/1954 Lang ..... 96/382
2,779,432 A 1/1957 Meyerhoefer
3,869,265 A * 3/1975 Wolter et al. ..... 15/327.2
4,780,986 A * 11/1988 Broomfield et al. ..... 43/139
5,248,323 A * 9/1993 Stevenson ..... 95/90
5,400,468 A * 3/1995 De Petra ..... 15/394
5,558,697 A * 9/1996 Dyson et al. ..... 95/12

FOREIGN PATENT DOCUMENTS

EP 500420 A1 * 8/1992
RU 2009561 A 3/1994
RU 2 019 121 C1 9/1994
RU 94025109 A 5/1996
WO WO 96/21389 A1 * 7/1996

* cited by examiner

*Primary Examiner*—Alan Diamond

(57) ABSTRACT

The invention provides a vacuum cleaner comprising an airflow path having a dirty air inlet (14) and a clean air outlet (44*e*), a fan (48) for drawing an airflow along the airflow path from the dirty air inlet (14) to the clean air outlet (44*e*), a motor (50) for driving the fan (48), separating apparatus (18) for separating dirt and dust from the airflow, a pre-motor filter (32) arranged upstream of the motor (50) and a post-motor filter (42) arranged downstream of the motor (50), wherein both the pre-motor filter (32) and the post-motor filter (42) are cylindrical filters. The invention further provides a vacuum cleaner comprising an airflow path having a dirty air inlet (14) and a clean air outlet (44*e*), a fan (48) for drawing an airflow along the airflow path from the dirty air inlet (14) to the clean air outlet (44*e*), a motor (48) for driving the fan (50), separating apparatus (18) for separating dirt and dust from the airflow, a pre-monitor filter (32) arranged upstream of the motor (50) and a post-motor filter (42) arranged downstream of the motor (50), wherein the post-motor filter (42) is housed in a casing (44) containing a plurality of slots or apertures (44*e*), the slots or apertures (44*e*) forming the clean air outlet and being arranged such that, in use, the airflow is diffused as it leaves the clean air outlet.

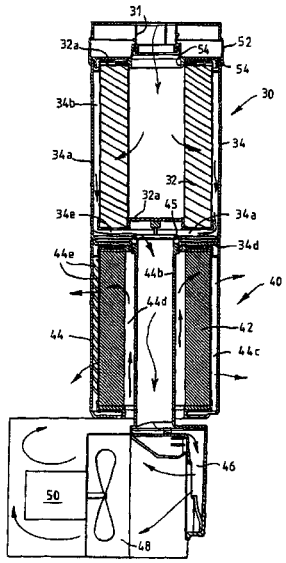

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–7 is confirmed.

Claims 1, 3, 4 and 8–21 are cancelled.

Claim 2 is determined to be patentable as amended.

New claims 22–34 are added and determined to be patentable.

2. A vacuum cleaner as claimed in claim [1] *5*, wherein the airflow is arranged to flow radially outwardly through each of the filters when the vacuum cleaner is in use.

*22. A vacuum cleaner comprising a dirty air inlet and a clean air outlet, a fan for drawing an airflow along the airflow path from the dirty air inlet to the clean air outlet, a motor for driving the fan, separating apparatus for separating dirt and dust from the airflow, a pre-motor filter arranged upstream of the motor and a post-motor filter arranged downstream of the motor, the post-motor filter lying between the pre-motor filter and the motor with an outlet of the pre-motor filter communicating with a passageway passing through the post-motor filter to the motor, wherein the post-motor filter is housed in a casing containing a plurality of slots or apertures, the slots or apertures forming the clean air outlet and being arranged such that, in use, the airflow is diffused as it leaves the clean air outlet.*

*23. A vacuum cleaner as claimed in claim 22, wherein the airflow is arranged to flow radially outwardly through each of the filters when the vacuum cleaner is in use.*

*24. A vacuum cleaner as claimed in claim 22, wherein the pre-motor filter and the post-motor filter are each housed in a transparent casing.*

*25. A vacuum cleaner as claimed in claim 24, wherein the pre-motor filter and the post motor filter are housed in separate transparent casings.*

*26. A vacuum cleaner as claimed in claim 25, wherein the pre-motor filter and post-motor filter are cylindrical and are arranged coaxially, the airflow path passing through the passageway through the post-motor filter between the pre-motor filter and the motor.*

*27. A vacuum cleaner as claimed in claim 26, wherein the cylindrical filters are positioned generally upright and parallel to the separating apparatus, the upper end of the uppermost casing being held in place by means of a retractable collar.*

*28. A vacuum cleaner as claimed in claim 22, wherein the slots or apertures extend around at least half of the circumference of the casing.*

*29. A vacuum cleaner as claimed in claim 22, wherein the casing is transparent.*

*30. A vacuum cleaner as claimed in claim 22, wherein the airflow is arranged to pass across or around the motor to provide cooling.*

*31. A vacuum cleaner as claimed in claim 22, wherein the separating apparatus comprises at least one cyclone.*

*32. A vacuum cleaner as claimed in claim 31, wherein the separating apparatus comprises two concentric cyclones.*

*33. A vacuum cleaner as claimed in claim 22, wherein the pre-motor filter and the post-motor filter are substantially the same size.*

*34. A vacuum cleaner as claimed in claim 22, wherein the airflow path passes through the centre of the post-motor filter between the pre-motor filter and the motor.*

* * * * *